United States Patent [19]

Rudy et al.

[11] 4,221,617

[45] Sep. 9, 1980

[54] SURFACTANT ADDITIVES FOR SOLID PROPELLANTS

[75] Inventors: Thomas P. Rudy, Saratoga; Jack K. West, Palo Alto, both of Calif.

[73] Assignee: United Technologies Corporation, East Hartford, Conn.

[21] Appl. No.: 583,458

[22] Filed: Sep. 30, 1966

[51] Int. Cl.[2] ..... C06B 45/10

[52] U.S. Cl. ..... 149/19.5; 149/19.6; 149/19.9; 149/19.92

[58] Field of Search ..... 149/19.9, 19.4, 19.6, 149/19.5, 19.92, 19

[56] References Cited

U.S. PATENT DOCUMENTS

| | | | |
|---|---|---|---|
| 2,946,671 | 7/1960 | Marti | 149/19 |
| 2,946,672 | 7/1960 | Marti | 149/19 |
| 3,260,631 | 7/1966 | Witz et al. | 149/19.4 |
| 3,883,375 | 5/1975 | Mastrolia et al. | 149/19.9 |
| 4,099,376 | 7/1978 | Japs | 149/19.9 |

*Primary Examiner*—Edward A. Miller

*Attorney, Agent, or Firm*—Steven F. Stone

[57] ABSTRACT

Certain surfactants as additives for castable composite solid propellants improve the physical properties of the cured solid propellant and improve the castability of the uncured solid propellant mix.

22 Claims, No Drawings

SURFACTANT ADDITIVES FOR SOLID PROPELLANTS

A typical castable solid propellant formulation normally comprises a mixture of particulate, reactive, solid ingredients suspended in a liquid composition which can be cured to provide a strong, elastic matrix. The reactive solid ingredients normally include an inorganic oxidizer such as ammonium perchlorate, ammonium nitrate or the like, a metal or metal hydride fuel, and minor amounts of burning catalysts or combustion modifiers such as iron oxide and carbon black. The curable liquid usually comprises an elastomeric prepolymer, crosslinking or curing agents, and a plasticizer.

Optimum ballistic performance of any particular system generally requires a high solids loading of the particulate material. However, when the solids loading exceeds about 70–75% by volume, the viscosity of the mix increases to the point where casting of the mix is no longer feasible. Although small grains can be extruded or pressure molded, casting is the only satisfactory way of manufacturing large solid propellant grains.

Surfactants have been employed in an attempt to reduce the viscosity of the mix and thereby improve castability, a commonly used surfactant being lecithin. The surfactant used must be compatible with the ingredients of the propellant mix and must not interfere with the cure mechanism. Unfortunately, there has been relatively little practical experience with respect to surface active agents for use with predominantly nonpolar organic liquids containing high solids loadings, and the mechanisms by which these agents function are poorly understood. According to this invention, we have found that the use of certain classes of additives produces a substantial improvement in the tensile strength and useful elongation of cured solid propellant grains and that these additives also permit the casting of hitherto uncastable propellant mixes having solids loadings of up to about 90% by weight.

It is, accordingly, an object of this invention to improve the physical properties of a solid propellant grain by inclusion therein of certain additives.

It is also another object of this invention to improve the castability of solid propellant mixes by inclusion therein of certain additives.

These and other objects of this invention will be readily apparent from the following description.

The additives usable according to this invention are:

(1) Heteropolymers of long chain alkyl acrylate esters with vinyl monomers containing weakly basic or neutral nitrogen atoms having molecular weights of from about 10,000 to 2.5 million.

(2) N-polyamine substituted alkenyl succinimides which may be prepared by condensation of a polyolefin with maleic anhydride followed by imidization with a polyethylene polyamine.

(3) Alkaline earth salts of alkarylsulfonic acids.

Within Group 1, the vinyl monomers with neutral nitrogen atoms are vinyl lactams such as the vinyl butyrolactams more commonly known as vinyl pyrrolidones and the vinyl valerolactams also known as vinyl piperidones.

The vinyl pyrrolidones are exemplified by N-vinyl pyrrolidone, N-(1-methylvinyl) pyrrolidone, N-vinyl-5-methyl pyrrolidone, N-vinyl-3,3-dimethyl pyrrolidone, N-vinyl-5-ethyl pyrrolidone, N-vinyl-3,3-dimethyl pyrrolidone, N-ethyl-3-vinyl pyrrolidone, N-butyl-5-vinyl pyrrolidone, 3-vinyl pyrrolidone, 4-vinyl pyrrolidone, 5-vinyl pyrrolidone and 5-cyclohexyl-N-vinyl pyrrolidone.

The vinyl piperidones are exemplified by N-vinyl piperidone, N-vinyl-6-methyl piperidone, N-vinyl-3-methyl piperidone and N-(1-methylvinyl) piperidone.

The vinyl monomers with weakly basic nitrogen atoms are vinylpyridines exemplified by 2-vinylpyridine, 3-vinylpyridine, 4-vinylpyridine as well as the ring substituted alkyl derivatives thereof as exemplified by 2-methyl-5-vinylpyridine, 4-methyl-2-vinylpyridine, 5-ethyl-2-vinylpyridine and 2-butyl-5-vinylpyridine and the like.

The long chain alkyl acrylate ester monomers are the acrylic and methacrylic acid esters of long chain aliphatic alcohols having from about 10–20 carbon atoms, which include straight or branched chain alcohols, e.g., decyl, dodecyl (lauryl), tetradecyl, hexadecyl octadecyl (stearyl) and eicosyl alcohols and mixtures thereof. Specific mixture combinations of these esters include dodecyl methacrylate/stearyl methacrylate, tetradecyl acrylate/stearyl methacrylate, hexadecyl methacrylate/stearyl methacrylate and the like.

In addition to the binary and ternary heteropolymers formed from the above materials, ternary and quaternary systems also including an acrylate ester of an aliphatic alcohol having up to 4 carbon atoms such as the acrylic and methacrylic acid esters of methanol, ethanol, propanol, isopropanol, butanol, sec-butyl alcohol and tertiary butyl alcohol, are useful in this invention. Heteropolymers of the types described above are known to the art and are described in U.S. Pat. Nos. 3,153,640, 2,957,854, 2,944,974 and 2,889,282.

The materials of group 2 are N-polyamine substituted alkenyl succinimides having the following general formula:

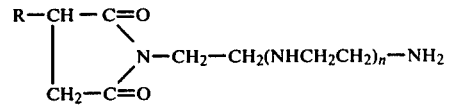

wherein n is an interger from 1 to 5 and preferably 3 and R is a polyolefin radical of from 30–200 carbon atoms and is derived from an olefin of 2 to 5 carbon atoms such as are described in U.S. Pat. No. 3,202,678. A preferred embodiment for use in this invention as exemplified by Example 5a, set forth below, is a compound in which R is a polyisobutylene chain having a molecular weight of about 1200.

The materials of Group 3 are surface active alkaline earth salts of alkarylsulfonic acids. Such materials are known to the art and are prepared by alkylation of an aromatic mucleus such as a benzene, naphthalene or anthracene nucleus followed by sulfonation to the sulfonic acid which may then be neutralized with an alkaline earth metal hydroxide to produce the desired salt of the alkarylsulfonic acid. Commercial processes for production of these materials generally employ a kerosene fraction for alkylation and accordingly the product is a mixture of alkylated arenesulfonic acids having varying chain lengths. Such materials are described in the Encyclopedia of Chemical Technology, Kirk & Othmer Vol. 13, P. 521–523, and are commercially available under a variety of trademarks and tradenames. Representative of particular materials commercially available are calcium decylbenzenesulfonate and calcium dodecylbenzenesulfonate. However, the salts of other alkaline earth metals can also be used as can compounds having other arene nuclei and compounds substituted with other alkyl groups and mixtures of such compounds.

The additives of this invention are usable in conjunction with a wide variety of binder systems employed in the production of castable solid propellants. Such binders are exemplified by carboxy-functional and hydroxy-functional polyolefins, polyesters and polyethers, e.g., polybutadienes, polyisoprenes, polyisobutylenes, copolymers of neopentyl glycol with azelaic acid, polypropylene oxides, polyethylene oxides and the like.

The effects of the additives employed according to this invention can best be illustrated by comparison with surfactants incorporated in a control propellant formulation.

EXAMPLES 1-11

A representative, marginally castable, propellant formulation having the following composition was used as the control:

| Component | Wt. % |
|---|---|
| Carboxy-Terminated Polybutadiene (Thiokol HC-434, eq. wt. 1950) | 12.02 |
| Tris [1-(2-methyl) aziridinyl] phosphine oxide (MAPO) | 0.45 |
| Epoxide (Shell EPON 812, eq. wt. 147) | 0.14 |
| Epoxide (Union Carbide ERL 2258, eq. wt. 132) | 0.14 |
| Dioctyl adipate | 2.25 |
| Aluminum, 40 micron spherical | 18.00 |
| Ferric oxide | 1.00 |
| Ammonium perchlorate | 66.00 |

The various surfactants employed, sometimes used as a dispersion in a mineral oil base, were added to provide 0.03 percent by weight of the surfactant in the composition and the amount of dioctyl adipate plasticizer used decreased correspondingly to maintain the concentration of the other ingredients at the values shown. The various formulations were mechanically mixed to provide uniform dispersion of the ingredients, and castability was determined immediately after mixing by rheometer test. The rheometer measures the weight of propellant which flows through a given orifice under a constant applied pressure, which in this case is 20 psig, during a fixed period of time. Those formulations which were castable were then cured at 160° F. for 120 hours. If the propellant cured, standard JANAF specimens were tested for tensile strenth and elongation by means of an Instron tensile tester.

The results are set forth in Table 1

TABLE I

| Example No. | Surfactant | Castability gm/min @ 20 psig | Physical Properties of Cured Propellant Tensile Strength, psi | Elongation, % | Comments |
|---|---|---|---|---|---|
| 1 | None (Control) | 10.8 | 131 | 29.6 | Marginally castable |
| 2 | Polymeric, mol. wt. 5,000 with neutral nitrogen atoms: Alkyl methacrylate/N-vinylpyrrolidone heteropolymer (Acryloid W 315X)* | 14.7 | 207 | 32.2 | Castable, substantial improvement in physical properties |
| 3 | Polymeric with weakly basic nitrogen atoms: Alkyl methacrylate/2-methyl-5-vinylpyridine heteropolymer** | 23.2 | 276 | 37.6 | Extremely castable & very substantial improvement in physical properties |
| 4 | Polymeric with strongly basic nitrogen atoms: Alkyl methacrylate/beta-dialkyl-aminoalkyl methacrylate heteropolymer DuPont LOA 564 N-polyamine substituted alkenyl succinimide | 2.1 | | | Not castable |
| 5a | Oronite OLOA-1200 | 8.6 | 207 | 28.5 | Marginally castable but substantial |
| 5b | Lubrizol 552 | 5.5 | 185 | 34.1 | improvement in physical properties |
| 5c | Lubrizol 894 | 6.0 | 184 | 33.3 | |
| 6 | Polyalkylene glycol ether (Tergitol XD) | 0.0 | | | Not castable |
| 7 | N-coco-trimethylenediamine diacetate (Duomac C50) | 11.5 | 134 | 30.3 | Marginally castable, negligible improvement in physical properties |
| 8 | Alkaline earth salts of alkaryl-sulfonic acids: | | | | Marginally castable, substantial improvement in physical properties |
| 8a | Barium alkarylsulfonate (Lubrizol 67) | 6.8 | 184 | 31.5 | |
| 8b | Calcium alkarylsulfonate: (Oronite OLOA-246A) | 6.0 | 225 | 32.9 | |
| 9 | Sodium alkarylsulfonate: Sodium dioctyl sulfosuccinate (Alrowet D65) | 15.0 | | | Failed to cure |
| 10 | Lecithin | 8.6 | 135 | 31.5 | Marginally castable, negligible improvement in physical properties |
| 11 | N-coco-trimethylenediamine (Duomeen C) | 16.0 | 134 | 36.2 | Gassed during cure, propellant too porous |

*poly (stearyl methacrylate/lauryl methacrylate/N-vinyl pyrrolidone) mol. wt. 10,000-15,000

**poly stearyl methacrylate (31%) lauryl methacrylate (52%)/methylmethacrylate (12%)/2-methyl-5-vinylpyridine (5%) mol. wt. 750,000-1,000,000

As can be seen from Table 1, the additives of this invention (Examples 2,3,5 and 8) all produced unexpected improvements in the physical properties of the cured propellant, and the additives of Examples 2 and 3 also noticeably improved the castability. Of the other materials used only one (Example 7) was found to improve the castability over that of the control while yielding a curable mix. However, there was no meaningful improvement in the physical properties of the cured propellant.

EXAMPLE 14

Another propellant formulation was prepared having the following composition:

| Component | % by Weight |
|---|---|
| Carboxy-terminated polybutadiene (Thiokol HC-434, eq. wt. 1873) | 11.99 |
| MAPO | 0.47 |
| ERL 2758 | 0.15 |
| EPON 812 | 0.14 |
| Dioctyl adipate | 2.25 |
| Aluminum 40 micron spherical | 18.00 |
| Ferric oxide | 1.00 |
| Ammonium perchlorate | 66.00 |

This formulation differs from the first formulation primarily in that a different lot of polymer was employed having a lower equivalent weight which necessitated minor modifications of the formulation. The materials were added to the mix to provide 0.20% by weight with modification of the diocytyl adipate content as desribed above. The rheometer readings were as follows:

| Additive | Castability Gm./Min. at 20 psig. |
|---|---|
| None (Control) | 5.2 |
| Acryloid W315X | 11.0 |
| Poly[stearyl methacrylate (34%)/ lauryl methacrylate (58%)12-methyl-5-vinylpyridine (7.5%)]Mol wt. 50,000 | 12.4 |
| Oronite OLOA 1200 | 9.1 |
| Oronite OLOA 246A | 8.3 |

In this experiment the additives of this invention all substantially increased the castability of the propellant above that of the control.

EXAMPLE 15

A propellant formulation employing a carboxy-terminated saturated hydrocarbon binder was used to compare the effectiveness of the additive of example 3 with that of the widely used conventional surfactant, lecithin.

| Basic Formulation | |
|---|---|
| Component | % by Wt. |
| Carboxy-terminated polyisobutylene (Eq. wt. 911) | 12.29 |
| MAPO (Eq. wt. 75) | 1.21 |
| Dioctyl adipate | 0.80 |
| Paraffin Oil | 1.60 |
| Aluminum (40 micron) | 16.00 |
| Ammonium Perchlorate | 68.10 |

The dioctyl adipate concentration was modified as above described when the additive was employed. The results are as follows:

| Additive | % by Weight | Rheometer Reading |
|---|---|---|
| Control | 0 | 12.2 |
| Poly[stearyl methacrylate (31%)/ lauryl methacrylate (52%)/methyl methacrylate (21%)/2-methyl-5-vinyl pyridine (5%)] | 0.04 | 21.4 |
| Lecithin | 0.04 | 16.0 |
| Lecithin | 0.40 | 16.2 |

As can be seen the polymer additive was far more effective than the conventional lecithin.

EXAMPLE 16

A propellant formulation containing 88% by weight of solid ingredients as set forth below was uncastable without the use of an additive according to this invention.

| Component | % by Weight |
|---|---|
| Carboxy-terminated polybutadiene (Thiokol HC-434, Eq. wt. 1860) | 9.68 |
| MAPO | 0.33 |
| Epoxide (Shell EPON 812 Eq. wt. 147) | 0.19 |
| Mineral Oil | 0.06 |
| Dioctyl adipate | 1.70 |
| Aluminum | 18.00 |
| Ammonium Perchlorate (trimodal particle size distribution) | 69.50 |
| Iron Oxide | 0.50 |
| Additive of Example #3 | 0.04 |

This formulation was processed in a 150 gallon mixer through a 75 minute mix cycle. Fory-five minutes after completion of the mix cycle the flow rate of the propellant at 160° F. exceeded 12 gm/min. The propellant was cast in the form of 14.5 pound center perforated grains and after curing for 5 days at 160° F. the propellant exhibited the following mechanical properties at 75° F.

Maximum Tensile strength: 160 psi.

Elongation at maximum stress: 36%.

Two grains were fired in a ballistic test motor at average chamber pressures of 395 and 480 psia and yielded corrected specific impulses of 238 and 241 sec, respectively.

The additives used according to this invention are preferably employed in amounts varying from about 0.01% to 0.5% by weight; however, higher or lower amounts can also be used. If lower amounts are employed, the improvements in the properties of the mix and cast propellant may be reduced. The use of larger amounts does not generally produce any substantial improvement in the propellant.

This invention has been described with respect to several specific examples, but these examples are to be considered illustrative rather than limiting of the invention. Many modifications and substitutions can be made without departing from the scope of this invention which is limited only by the following claims wherein we claim:

We claim:

1. In a process for preparing a castable solid propellant wherein solid particulate material is admixed with a curable binder system selected from the group consisting of functionally substituted polyolefins, polyesters and polyethers to form a castable mix, said mix is cast into a suitable mold and subsequently cured to form a propellant grain, the improvement which comprises incorporating in said mix a material selected from the group consisting of heteropolymers of a vinyl lactam and long chain aliphatic acrylate esters, heteropolymers of a vinylpyridine and long chain aliphatic acrylate esters, N-polyamine substituted alkenyl succinimides, and alkaline earth salts of alkarylsulfonic acids.

2. The method of claim 1 wherein said heteropolymers of a vinylpyridine and long chain aliphatic acrylate esters contain as an additional component short chain aliphatic acrylate esters.

3. The method of claim 1 wherein said material is a poly(stearyl methacrylate/lauryl methacrylate/N-vinyl pyrrolidone).

4. The method of claim 1 wherein said material is poly(stearyl methacrylate/lauryl methacrylate/methyl methacrylate/2-methyl-5-vinylpyridine).

5. The method of claim 1 wherein said material is poly(stearyl methacrylate/lauryl methacrylate/2-methyl-5-vinylpyridine).

6. The method of claim 1 wherein said material has the general formula:

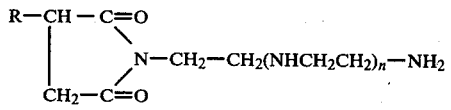

wherein n is an integer from 1 to 5 and R is a polyolefin radical of from 30–200 carbon atoms and is derived from an olefin having from 2 to 5 carbon atoms.

7. The method of claim 6 wherein n is 3 and R is a polyisobutylene chain having a molecular weight of about 1200.

8. The method of claim 1 wherein said material is an alkaline earth metal salt of alkarylsulfonic acids.

9. The method of claim 8 wherein said alkaline earth metal is calcium.

10. The method of claim 8 wherein said alkaline earth metal is barium.

11. A cast solid propellant grain comprising a cured binder matrix selected from the group consisting of cross-linked polyolefins, polyesters, and polyethers having dispersed therethrough particulate reactive materials and a material selected from the group consisting of heteropolymers of a vinyl lactam and long chain aliphatic acrylate esters, heteropolymers of a vinylpyridine and long chain aliphatic acrylate esters, N-polyamine substituted alkenyl succinimides, and alkaline earth salts of alkarylsulfonic acids.

12. The propellant grain of claim 11 wherein said heteropolymers of a vinylpyridine and long chain aliphatic acrylate esters contain as an additional component short chain aliphatic acrylate esters.

13. The propellant grain of claim 11 wherein said material is a poly(stearyl methacrylate/lauryl methacrylate/N-vinylpyrrolidone).

14. The propellant grain of claim 11 wherein said material is poly(stearyl methacrylate/lauryl methacrylate/methyl methacrylate/2-methyl-5-vinylpyridine).

15. The propellant grain of claim 11 wherein said material is poly(stearyl methacrylate/laury methacrylate/2-methyl-5-vinylpyridine).

16. The propellant grain of claim 11 wherein said material has the general formula:

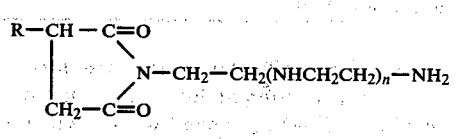

wherein n is an interger from 1 to 5 and R is a polyolefin radical of from 30–200 carbon atoms and is derived from an olefin having from 2 to 5 carbon atoms.

17. The propellant grain of claim 16 wherein n is 3 and R is a polyisobutylene chain having a molecular weight of about 1200.

18. The propellant grain of claim 11 wherein said material is an alkaline earth metal salt of alkarylsulfonic acids.

19. The propellant grain of claim 18 wherein said alkaline earth metal is calcium.

20. The propellant grain of claim 18 wherein said alkaline earth metal is barium.

21. The method of claim 1 wherein said material is present in amount of from 0.01% to 0.5% by weight.

22. The propellant grain of claim 11 wherein said material is present in amounts from 0.01% to 0.5% by weight.

* * * * *